US009538301B2

(12) United States Patent
Kechichian et al.

(10) Patent No.: US 9,538,301 B2
(45) Date of Patent: Jan. 3, 2017

(54) DEVICE COMPRISING A PLURALITY OF AUDIO SENSORS AND A METHOD OF OPERATING THE SAME

(75) Inventors: Patrick Kechichian, Eindhoven (NL); Wilhelmus Andreas Martinus Arnoldus Maria Van Den Dungen, Boxtel (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 495 days.

(21) Appl. No.: 13/988,050

(22) PCT Filed: Nov. 21, 2011

(86) PCT No.: PCT/IB2011/055198

§ 371 (c)(1),
(2), (4) Date: Jan. 16, 2014

(87) PCT Pub. No.: WO2012/069973

PCT Pub. Date: May 31, 2012

(65) Prior Publication Data

US 2014/0119548 A1 May 1, 2014

(30) Foreign Application Priority Data

Nov. 24, 2010 (EP) ..... 10192400

(51) Int. Cl.
*H04R 29/00* (2006.01)
*H04R 3/00* (2006.01)

(52) U.S. Cl.
CPC ..... *H04R 29/00* (2013.01); *H04R 3/005* (2013.01); *H04R 2460/13* (2013.01)

(58) Field of Classification Search
CPC ..... H04R 29/00; H04R 3/005; H04R 2460/13
(Continued)

(56) References Cited

U.S. PATENT DOCUMENTS 6,952,672 B2 10/2005 Smith
7,499,686 B2 3/2009 Sinclair et al.
(Continued)

FOREIGN PATENT DOCUMENTS

CN 101150883 A 3/2008
CN 101645697 A 2/2010
(Continued)

OTHER PUBLICATIONS

Boll: "Suppression of Acoustic Noise in Speech Using Spectral Subtraction"; IEEE Transactions on Acoustics, Speech, and Signal Processing, vol. ASSP-27, No. 2, Apr. 1979, pp. 113-120.
(Continued)

*Primary Examiner* — Sonia Gay

(57) ABSTRACT

There is provided a method of operating a device, the device comprising a plurality of audio sensors and being configured such that when a first audio sensor of the plurality of audio sensors is in contact with a user of the device, a second audio sensor of the plurality of audio sensors is in contact with the air, the method comprising obtaining respective audio signals representing the speech of a user from the plurality of audio sensors; and analyzing the respective audio signals to determine which, if any of the plurality of audio sensors is in contact with the user of the device.

13 Claims, 9 Drawing Sheets

(58) Field of Classification Search
USPC ..... 381/56
See application file for complete search history.

(56) References Cited

U.S. PATENT DOCUMENTS

| | | | | |
|---|---|---|---|---|
| 2001/0016046 | A1 | 8/2001 | Ohta | |
| 2005/0114124 | A1 | 5/2005 | Liu et al. | |
| 2005/0185813 | A1* | 8/2005 | Sinclair et al. | 381/380 |
| 2007/0036370 | A1* | 2/2007 | Granovetter et al. | 381/311 |
| 2008/0071547 | A1 | 3/2008 | Prieto et al. | |
| 2009/0296965 | A1 | 12/2009 | Kojima | |
| 2010/0224191 | A1 | 9/2010 | Dixon et al. | |

FOREIGN PATENT DOCUMENTS

| | | | |
|---|---|---|---|
| EP | 0683621 | | 5/1995 |
| EP | 1569422 | | 8/2005 |
| EP | 1640972 | | 12/2005 |
| JP | 42962 | | 1/1967 |
| JP | 58036526 | A | 3/1983 |
| JP | H07312634 | A | 11/1995 |
| JP | 11113079 | A | 4/1999 |
| JP | 2002125298 | A | 4/2002 |
| JP | 2003057341 | A | 2/2003 |
| JP | 2004279768 | A | 10/2004 |
| JP | 2006126558 | A | 5/2006 |
| JP | 2009206885 | A | 9/2009 |
| JP | 2014502468 | A | 1/2014 |
| KR | 2003040610 | A | 5/2003 |
| WO | 2009141828 | A2 | 11/2009 |
| WO | 2012069966 | A | 5/2012 |

OTHER PUBLICATIONS

Isvan: "Noise Reduction Method by Which a Primary Input Signal Is Gated by a Secondary Input Signal"; Apr. 2001, Plantronics, Inc, 7 Page Document.

Liu et al: "Direct Filtering for Air-And Bone-Conductive Microphones"; 2004 IEEE 6th Workshop on Multimedia Signal Processing, 2004, pp. 363-366.

Makhoul: "Linear Prediction: A Tutorial Review"; Proceedings of the IEEE, vol. 63, No. 4, Apr. 1975, pp. 561-580.

Martin: "Spectral Subtraction Based on Minimum Statistics"; Signal Processing VII, Proc. Eusipco 94, pp. 1182-1185, 1994.

Moser et al: "Relative Intensities of Sounds At Various Anatomical Locations of the Head and Neck During Phonation of the Vowels"; The Journal of the Acoustical Society of America, vol. 30, No. 4, April 1958, pp. 275-277.

Sambur et al: "LPC Analysis/Synthesis From Speech Inputs Containing Quantizing Noise or Additive White Noise"; IEEE Transactions on Acoustics, Speech, and Signal Processing, vol. ASSP-24, No. 6, Dec. 1976, pp. 488-494.

Shimamura et al: "A Reconstruction Filter for Bone-Conducted Speech"; IEEE, Circuits and Systems, 2005, pp. 1847-1850.

Viswanathan et al: "Multisensor Speech Input for Enhanced Immunity to Acoustic Background Noise"; , IEEE International Conference on Acoustics, Speech, and Signal Processing, Mar. 1984, vol. 9, pp. 18A.3.1-18A.3.4.

Vu et al: "An LP-Based Blind Model for Restoring Bone-Conducted Speech", 2008 IEEE, pp. 212-217.

Vu et al: "A Study on an LP-Based Model for Restoring Bone-Conducted Speech"; 2006 IEEE, pp. 294-299.

Zhu et al: "A Robust Speech Enhancement Scheme on the Basis of Bone-Conductive Microphones"; pp. 353-355.

* cited by examiner

DEVICE COMPRISING A PLURALITY OF AUDIO SENSORS AND A METHOD OF OPERATING THE SAME

TECHNICAL FIELD OF THE INVENTION

The invention relates to a device comprising a plurality of audio sensors such as microphones and a method of operating the same, and in particular to a device configured such that when a first audio sensor of the plurality of audio sensors is in contact with a user of the device, a second sensor of the plurality of sensors is in contact with the air.

BACKGROUND TO THE INVENTION

Mobile devices are frequently used in acoustically harsh environments (i.e. environments where there is a lot of background noise). Aside from problems with a user of the mobile device being able to hear the far-end party during two-way communication, it is difficult to obtain a 'clean' (i.e. noise free or substantially noise-reduced) audio signal representing the speech of the user. In environments where the captured signal-to-noise ratio (SNR) is low, traditional speech processing algorithms can only perform a limited amount of noise suppression before the near-end speech signal (i.e. that obtained by the microphone in the mobile device) can become distorted with 'musical tones' artifacts.

It is known that audio signals obtained using a contact sensor, such as a bone-conducted (BC) or contact microphone (i.e. a microphone in physical contact with the object producing the sound) are relatively immune to background noise compared to audio signals obtained using an air-conducted (AC) sensor, such as a microphone (i.e. a microphone that is separated from the object producing the sound by air), since the sound vibrations measured by the BC microphone have propagated through the body of the user rather than through the air as with a normal AC microphone, which, in addition to capturing the desired audio signal, also picks up the background noise. Furthermore, the intensity of the audio signals obtained using a BC microphone is generally much higher than that obtained using an AC microphone. Therefore, BC microphones have been considered for use in devices that might be used in noisy environments. FIG. 1 shows that the BC signal is relatively immune to environmental noise whereas the AC signal is not and illustrates the high SNR properties of an audio signal obtained using a BC microphone relative to an audio signal obtained using an AC microphone in the same noisy environment. In FIG. 1 the vertical axis shows the amplitude of the audio signal.

However, a problem with speech obtained using a BC microphone is that its quality and intelligibility are usually much lower than speech obtained using an AC microphone. This reduction in intelligibility generally results from the filtering properties of bone and tissue, which can severely attenuate the high frequency components of the audio signal.

The quality and intelligibility of the speech obtained using a BC microphone depends on its specific location on the user. The closer the microphone is placed near the larynx and vocal cords around the throat or neck regions, the better the resulting quality and intensity of the BC audio signal. Furthermore, since the BC microphone is in physical contact with the object producing the sound, the resulting signal has a higher SNR compared to an AC audio signal which also picks up background noise.

However, although speech obtained using a BC microphone placed in or around the neck region will have a much higher intensity, the intelligibility of the signal will still be quite low, which is attributed to the filtering of the glottal signal through the bones and soft tissue in and around the neck region and the lack of the vocal tract transfer function.

The characteristics of the audio signal obtained using a BC microphone also depend on the housing of the BC microphone, i.e. is it shielded from background noise in the environment, as well as the pressure applied to the BC microphone to establish contact with the user's body.

Therefore, filtering or speech enhancement methods have been developed that aim to improve the intelligibility of speech obtained from a BC microphone, and these methods generally require either the presence of a clean speech reference signal in order to construct an equalization filter for application to the audio signal from the BC microphone, or the training of user-specific models using a clean audio signal from an AC microphone. Alternative methods exist that aim to improve the intelligibility of speech obtained from an AC microphone using properties of a speech signal from a BC microphone.

SUMMARY OF THE INVENTION

Mobile personal emergency response systems (MPERS) include a user-worn pendant or similar device that includes a microphone for allowing the user to contact a care provider or emergency service in an emergency. As these devices may have to be used in noisy environments, it is desirable to provide a device that gives the best possible speech audio signal from the user, so the use of BC microphones and AC microphones in these devices has been considered.

However, a pendant is free to move relative to the user (for example by rotating), so the specific microphone in contact with the user may change over time (i.e. a microphone may be a BC microphone at one moment and an AC microphone the next). It is also possible for none of the microphones to be in contact with the user at a given moment (i.e. all microphones are AC microphones). This causes problems for the subsequent circuitry in the device 2 that processes the audio signals to generate the enhanced audio signal, since specific processing operations are usually performed on particular (i.e. BC or AC) audio signals.

Therefore, there is a need for a device and method of operating the same that overcomes this problem.

According to a first aspect of the invention, there is provided a method of operating a device, the device comprising a plurality of audio sensors and being configured such that when a first audio sensor of the plurality of audio sensors is in contact with a user of the device, a second audio sensor of the plurality of audio sensors is in contact with the air, the method comprising obtaining respective audio signals representing the speech of a user from the plurality of audio sensors; and analyzing the respective audio signals to determine which, if any of the plurality of audio sensors is in contact with the user of the device.

Preferably, the step of analyzing comprises analyzing the spectral properties of each of the audio signals. Even more preferably, the step of analyzing comprises analyzing the power of the respective audio signals above a threshold frequency. It can be determined that an audio sensor is in contact with the user of the device if the power of its respective audio signal above the threshold frequency is less than the power of an audio signal above the threshold frequency from another audio sensor by more than a predetermined amount.

In one particular embodiment, the step of analyzing comprises applying an N-point Fourier transform to each audio signal; determining information on the power spectrum below a threshold frequency for each of the Fourier-transformed audio signals; normalizing the Fourier-transformed audio signals from the two sensors with respect to each other according to the determined information; and comparing the power spectrum above the threshold frequency of the normalized Fourier-transformed audio signals to determine which, if any, of the plurality of audio sensors is in contact with the user of the device.

In one implementation, the step of determining information comprises determining the value of a maximum peak in the power spectrum below the threshold frequency for each of the Fourier-transformed audio signals, but in an alternative implementation the step of determining information comprises summing the power spectrum below the threshold frequency for each of the Fourier-transformed audio signals.

It can be determined that an audio sensor is in contact with the user of the device if the power spectrum above the threshold frequency for its respective Fourier-transformed audio signal is less than the power spectrum above the threshold frequency for a Fourier-transformed audio signal from another audio sensor by more than a predetermined amount.

It can be determined that no audio sensor is in contact with the user of the device if the power spectrums above the threshold frequency for the Fourier-transformed audio signals differ by less than a predetermined amount.

Preferably, the method further comprises the step of providing the audio signals to circuitry that processes the audio signals to produce an output audio signal representing the speech of the user according to the result of the step of analyzing.

According to a second aspect of the invention, there is provided a device, comprising a plurality of audio sensors arranged in the device such that when a first audio sensor of the plurality of audio sensors is in contact with a user of the device, a second audio sensor of the plurality of audio sensors is in contact with the air; and circuitry that is configured to obtain respective audio signals representing the speech of a user from the plurality of audio sensors; and analyze the respective audio signals to determine which, if any, of the plurality of audio sensors is in contact with the user of the device.

Preferably, the circuitry is configured to analyze the power of the respective audio signals above a threshold frequency.

In a particular embodiment, the circuitry is configured to analyze the respective audio signals by applying an N-point Fourier transform to each audio signal; determining information on the power spectrum below a threshold frequency for each of the Fourier-transformed audio signals; normalizing the Fourier-transformed audio signals from the two sensors with respect to each other according to the determined information; and comparing the power spectrum above the threshold frequency of the normalized Fourier-transformed audio signals to determine which, if any, of the plurality of audio sensors is in contact with the user of the device.

Preferably, the device further comprises processing circuitry for receiving the audio signals and for processing the audio signals according to produce an output audio signal representing the speech of the user.

According to a third aspect of the invention, there is provided a computer program product comprising computer readable code that is configured such that, on execution of the computer readable code by a suitable computer or processor, the computer or processor performs the method described above.

BRIEF DESCRIPTION OF THE DRAWINGS

Exemplary embodiments of the invention will now be described, by way of example only, with reference to the following drawings, in which.

DETAILED DESCRIPTION OF THE PREFERRED EMBODIMENTS

Figure 1:
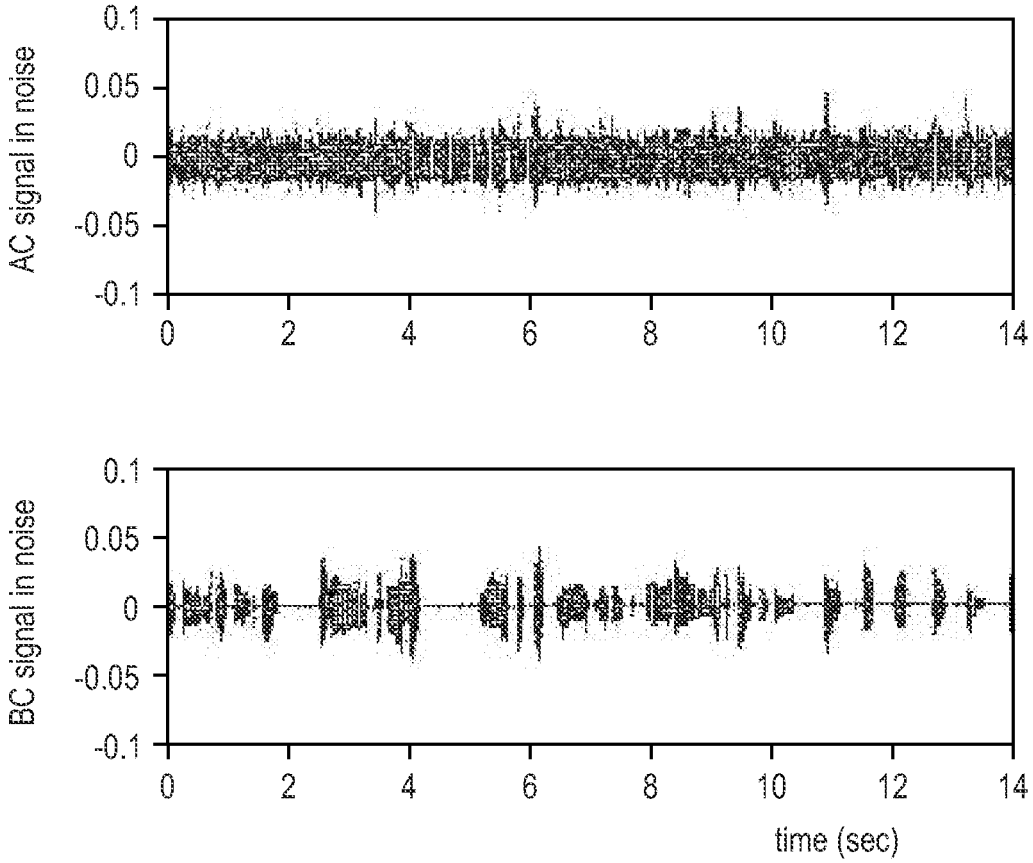
FIG. 1 illustrates the high SNR properties of an audio signal obtained using a BC microphone relative to an audio signal obtained using an AC microphone in the same noisy environment.
Figure 2:
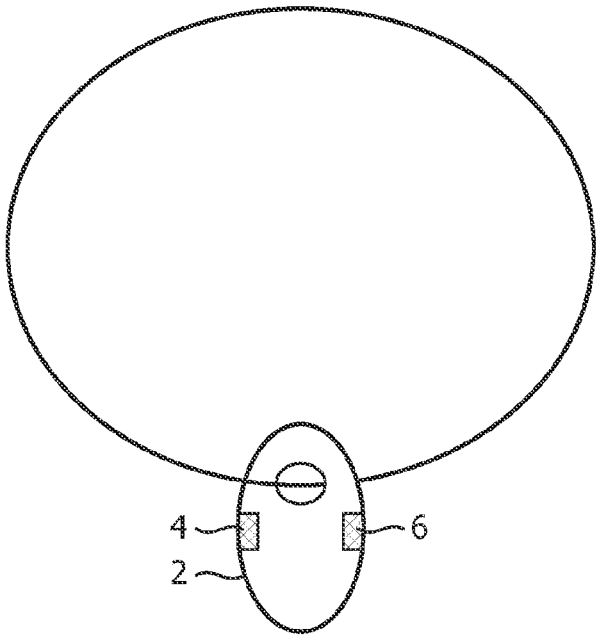
FIG. 2 is a block diagram of a pendant including two microphones.

Referring to FIG. 2, a device 2, in the form of a pendant, comprises two sensors 4, 6 arranged on opposite sides or faces of the pendant 2 such that when one of the two sensors 4, 6 is in contact with the user, the other sensor is in contact with the air. The sensor 4, 6 in contact with the user will act as a bone-conducted or contact sensor (and provide a BC audio signal) and the sensor 4, 6 in contact with the air will act as an air-conducted sensor (and provide an AC audio signal). The sensors 4, 6 are generally the same type and configuration. In the illustrated embodiments, the sensors 4, 6 are microphones, that may be based on MEMS technology. Those skilled in the art will appreciate that the sensors 4, 6 can be implemented using other types of sensor or transducer.

The device 2 may be attached to a cord such that it can be won around a user's neck. The cord and device may be arranged such that the device, when worn as a pendant, has a predetermined orientation with respect to the body of the user to guarantee that one of the sensors 4, 6 is in contact with the user. Further the device may be shaped such that it is rotation invariant thereby preventing that in use due to motion of the user the device orientation changes and the contact of said one sensor with the user is lost. The shape of the device may for example be a rectangle.

Figure 3:
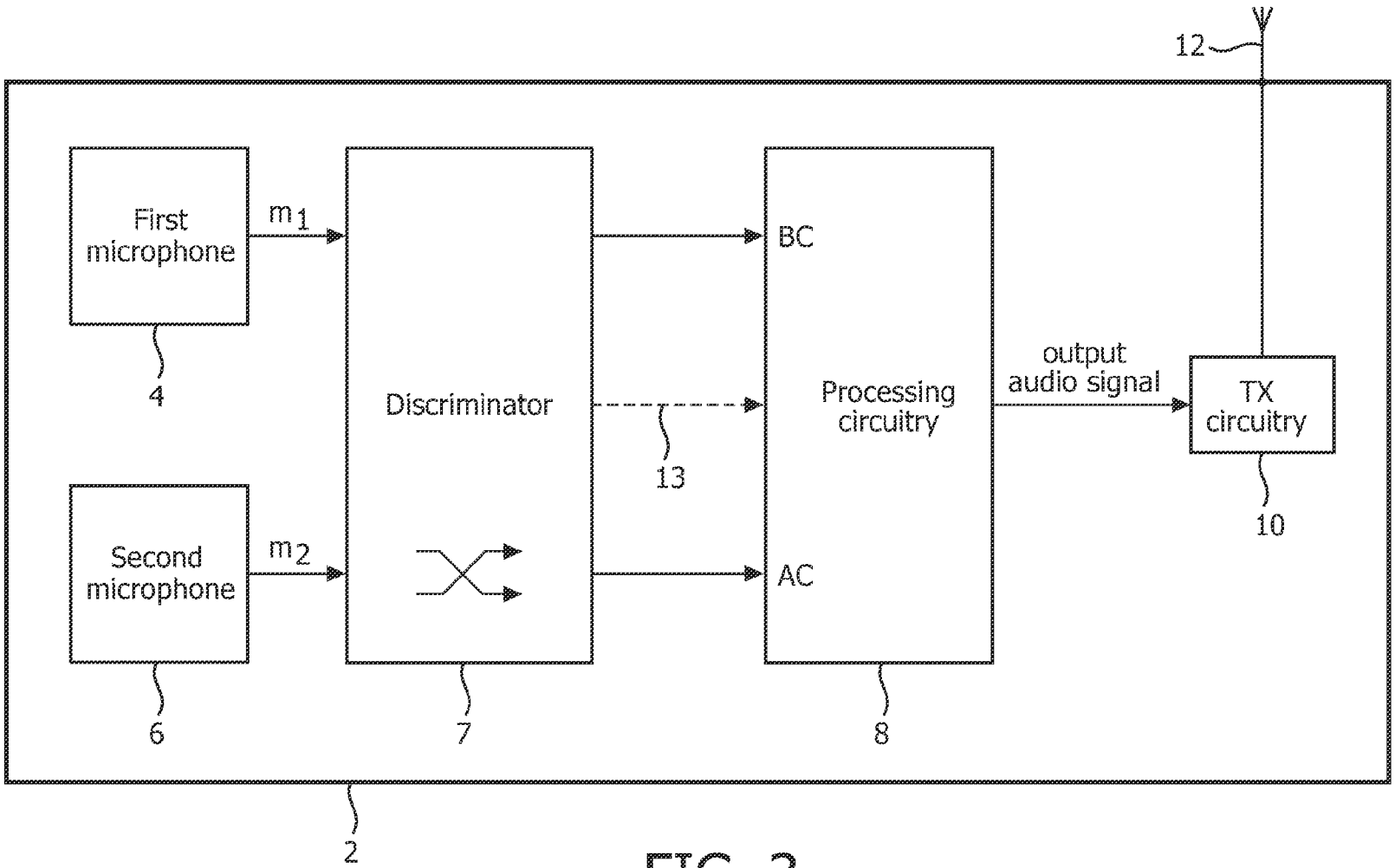
FIG. 3 is a block diagram of a device according to a first embodiment of the invention.

A block diagram of a device 2 according to the invention is shown in FIG. 3. As described above, the device 2 comprises two microphones: a first microphone 4 and a second microphone 6 that are positioned in the device 2 such that when one of the microphones 4, 6 is in contact with a part of the user, the other microphone 4, 6 is in contact with the air.

The first microphone 4 and second microphone 6 operate simultaneously (i.e. they capture the same speech at the same time) to produce respective audio signals (labeled $m_1$ and $m_2$ in FIG. 3).

The audio signals are provided to a discriminator block 7 which analyses the audio signals to determine which, if any, corresponds to a BC audio signal and an AC audio signal.

The discriminator block 7 then outputs the audio signals to circuitry 8 that carries out processing to improve the quality of the speech in the audio signals.

The processing circuitry 8 can perform any known speech enhancement algorithm on the BC audio signal and AC audio signal to generate a clean (or at least improved) output audio signal representing the speech of the user. The output audio signal is provided to transmitter circuitry 10 for transmission via antenna 12 to another electronic device (such as a mobile telephone or a device base station).

If the discriminator block 7 determines that neither microphone 4, 6 is in contact with the body of the user, then the discriminator block 7 can output both AC audio signals to the processing circuitry 8, which then performs an alternative speech enhancement method based on the presence of multiple AC audio signals (for example beamforming).

Figure 4A:
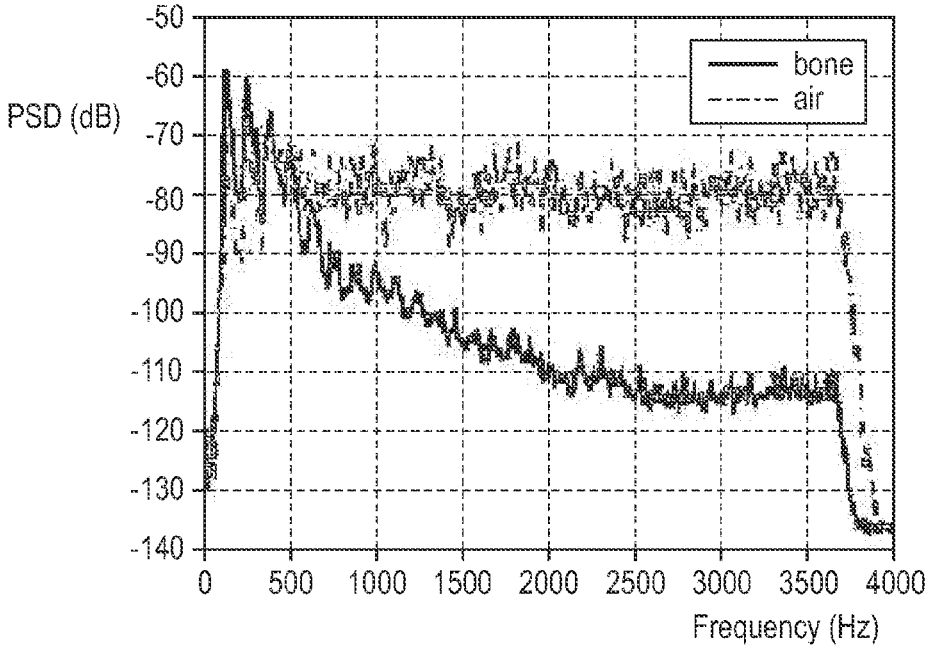
FIGS. 4A and 4B are graphs showing a comparison between the power spectral densities between signals obtained from a BC microphone and an AC microphone with and without background noise respectively.
Figure 4B:
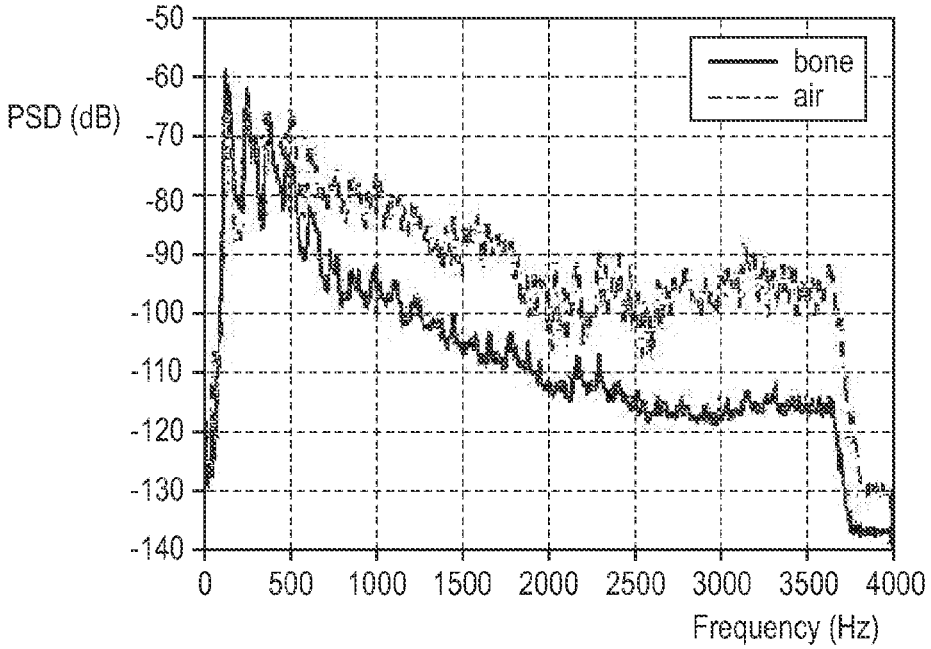

It is known that high frequencies of speech in a BC audio signal are attenuated due to the transmission medium (for example frequencies above 1 kHz), which is demonstrated by the graphs in FIG. 3 that show a comparison of the power spectral densities of BC and AC audio signals in the presence of background diffuse white noise (FIG. 4A) and without background noise (FIG. 4B). This property can therefore be used by the discriminator block 7 to differentiate between BC and AC audio signals.

Figure 5:
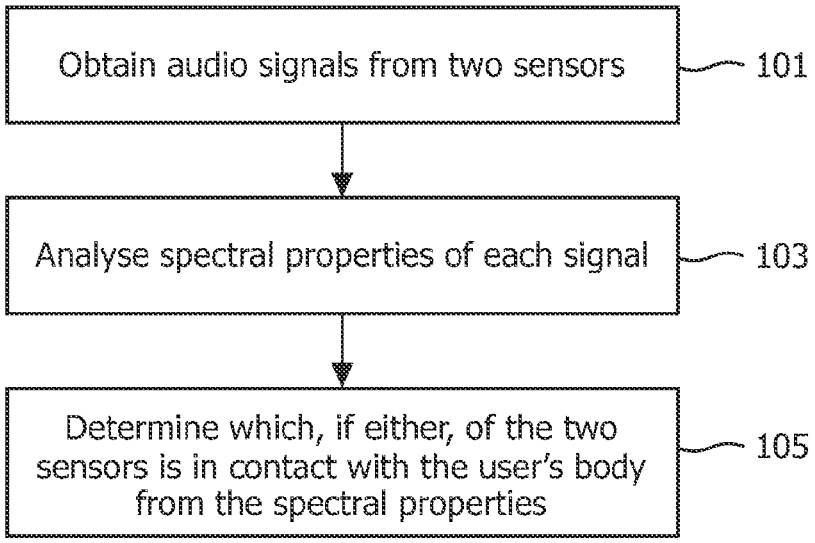
FIG. 5 is a flow chart illustrating a method according to an embodiment of the invention.

An exemplary embodiment of a method according to the invention is shown in FIG. 5. In step 101, respective audio signals are obtained simultaneously using the first microphone 4 and the second microphone 6 and the audio signals are provided to the discriminator block 7. Then, in steps 103 and 105, the discriminator block 7 analyses the spectral properties of each of the audio signals, and detects which, if any, of the first and second microphones 4, 6 are in contact with the body of the user based on the spectral properties. In one embodiment, the discriminator block 7 analyses the spectral properties of each of the audio signals above a threshold frequency (for example 1 kHz).

However, a difficulty arises from the fact that the two microphones 4, 6 might not be calibrated, i.e. the frequency response of the two microphones 4, 6 might be different. In this case, a calibration filter can be applied to one of the microphones before proceeding with the discriminator block 7 (not shown in the Figures). Thus, in the following, it can be assumed that the responses are equal up to a wideband gain, i.e. the frequency responses of the two microphones have the same shape.

In the following operation, the discriminator block 7 compares the spectra of the audio signals from the two microphones 4, 6 to determine which audio signal, if any, is a BC audio signal. If the microphones 4, 6 have different frequency responses, this can be corrected with a calibration filter during production of the device 2 so the different microphone responses do not affect the comparisons performed by the discriminator block 7.

Even if this calibration filter is used, it is still necessary to account for some gain differences between AC and BC audio signals as the intensity of the AC and BC audio signals is different, in addition to their spectral characteristics (in particular the frequencies above 1 kHz).

Thus, the discriminator block 7 normalizes the spectra of the two audio signals above the threshold frequency (solely for the purpose of discrimination) based on global peaks found below the threshold frequency, and compares the spectra above the threshold frequency to determine which, if any, is a BC audio signal. If this normalization is not performed, then, due to the high intensity of a BC audio signal, it might be determined that the power in the higher frequencies is still higher in the BC audio signal than in the AC audio signal, which would not be the case.

Figure 6:
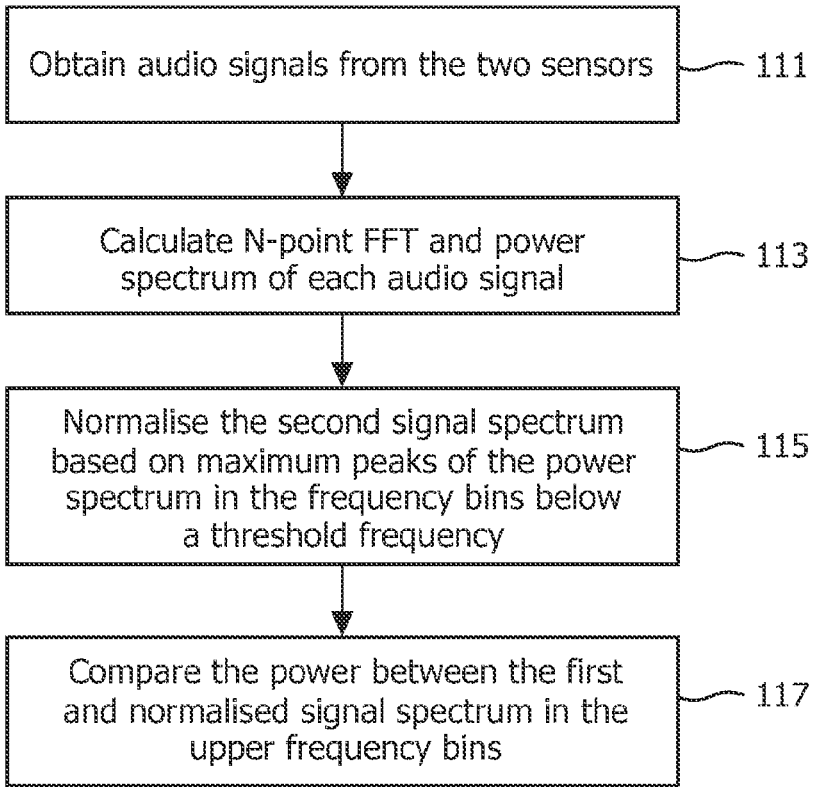
FIG. 6 is a flow chart illustrating a method according to a more specific embodiment of the invention.

A particular embodiment of the invention is shown in the flow chart of FIG. 6. In the following, it is assumed that any calibration required to account for differences in the frequency response of the microphones 4, 6 has been performed, and it is assumed that the respective audio signals from the BC microphone 4 and AC microphone 6 are time-aligned using appropriate time delays prior to the further processing of the audio signals described below. In step 111, respective audio signals are obtained simultaneously using the first microphone 4 and the second microphone 6 and provided to the discriminator block 7.

In step 113, the discriminator block 7 applies an N-point (single-sided) fast Fourier transform (FFT) to the audio signals from each microphone 4, 6 as follows:

$$M_1(\omega)=\mathrm{FFT}\{m_1(t)\} \tag{1}$$

$$M_2(\omega)=\mathrm{FFT}\{m_2(t)\} \tag{2}$$

producing N frequency bins between $\omega=0$ radians (rad) and $\omega=2\pi f_s$ rad where $f_s$ is the sampling frequency in Hertz (Hz) of the analog-to-digital converters which convert the analog microphone signals to the digital domain. Apart from the first N/2+1 bins including the Nyquist frequency $\pi f_s$, the remaining bins can be discarded. The discriminator block 7 then uses the result of the FFT on the audio signals to calculate the power spectrum of each audio signal.

Then, in step 115, the discriminator block 7 finds the value of the maximum peak of the power spectrum among the frequency bins below a threshold frequency $\omega_c$:

$$p_1 = \max_{0<\omega<\omega_c} |M_1(\omega)|^2 \tag{3}$$

$$p_2 = \max_{0<\omega<\omega_c} |M_2(\omega)|^2 \tag{4}$$

and uses the maximum peaks to normalize the power spectra of the audio signals above the threshold frequency $\omega_c$. The threshold frequency $\omega_c$ is selected as a frequency above which the spectrum of the BC audio signal is generally attenuated relative to an AC audio signal. The threshold frequency $\omega_c$ can be, for example, 1 kHz. Each frequency bin contains a single value, which, for the power spectrum, is the magnitude squared of the frequency response in that bin.

Alternatively, in step 115 the discriminator block 7 can find the summed power spectrum below $\omega_c$ for each audio signal, i.e.

$$p_1 = \sum_{\omega=0}^{\omega_c} |M_1(\omega)|^2 \tag{5}$$

$$p_2 = \sum_{\omega=0}^{\omega_c} |M_2(\omega)|^2 \tag{6}$$

and can normalize the power spectra of the audio signals above the threshold frequency $\omega_c$ using the summed power spectra.

As the low frequency bins of an AC audio signal and a BC audio signal should contain roughly the same low-frequency information, the values of $p_1$ and $p_2$ are used to normalize the signal spectra from the two microphones 4, 6, so that the high frequency bins for both audio signals can be compared (where discrepancies between a BC audio signal and AC audio signal are expected to be found) and a potential BC audio signal identified.

In step 117, the discriminator block 7 then compares the power between the spectrum of the signal from the first microphone 4 and the spectrum of the signal from the normalized second microphone 6 in the upper frequency bins:

$$\sum_{\omega>\omega_c} |M_1(\omega)|^2 <=> p_1/(p_2+\epsilon) \sum_{\omega>\omega_c} |M_2(\omega)|^2 \tag{7}$$

where $\epsilon$ is a small constant to prevent division by zero, and $p_1/(p_2+\epsilon)$ represents the normalization of the spectra of the second audio signal (although it will be appreciated that the normalization could be applied to the first audio signal instead).

Provided that the difference between the power of the two audio signals is greater than a predetermined amount (that depends on the location of the bone-conducting microphone and can be determined experimentally), the audio signal with the largest power in the normalized spectrum above $\omega_c$ is determined to be an audio signal from an AC microphone, and the audio signal with the smallest power is determined to be an audio signal from a BC microphone.

However, if the difference between the power of the two audio signals is less than the predetermined amount, then it is not possible to determine positively that either one of the audio signals is a BC audio signal (and it may be that neither microphone 4, 6 is in contact with the body of the user).

It will be appreciated that, instead of calculating the modulus squared in the above equations in step 117, it is possible to calculate the modulus values.

It will also be appreciated that alternative comparisons between the power of the two signals can be made in step 117 using a bounded ratio so that uncertainties can be accounted for in the decision making. For example, a bounded ratio of the powers in frequencies above the threshold frequency can be determined:

$$\frac{p_1 - p_2}{p_1 + p_2} \tag{8}$$

with the ratio being bounded between −1 and 1, with values close to 0 indicating uncertainty in which microphone, if any, is a BC microphone.

The discriminator block 7 includes switching circuitry that outputs the audio signal determined to be a BC audio signal to a BC audio signal input of the processing circuitry 8 and the audio signal determined to be an AC audio signal to an AC audio signal input of the processing circuitry 8. The processing circuitry 8 then performs a speech enhancement algorithm on the BC audio signal and AC audio signal to generate a clean (or at least improved) output audio signal representing the speech of the user.

If, due to uncertainty, both audio signals are determined to be AC audio signals, the switching circuitry in the discriminator block 7 can output the signals to alternative audio signal inputs of the processing circuitry 8 (not shown in FIG. 3). The processing circuitry 8 can then treat both audio signals as AC audio signals and process them using conventional two-microphone techniques, for example by combining the AC audio signals using beamforming techniques.

In an alternative embodiment, the switching circuitry may be part of the processing circuitry 8, which means that the discriminator block 7 can output the audio signal from the first microphone 4 to a first audio signal input of the processing circuitry 8 and the audio signal from the second microphone 6 to a second audio signal input of the processing circuitry 8, along with a signal 13 indicating which, if any, of the audio signals is a BC or AC audio signal.

Figure 7:
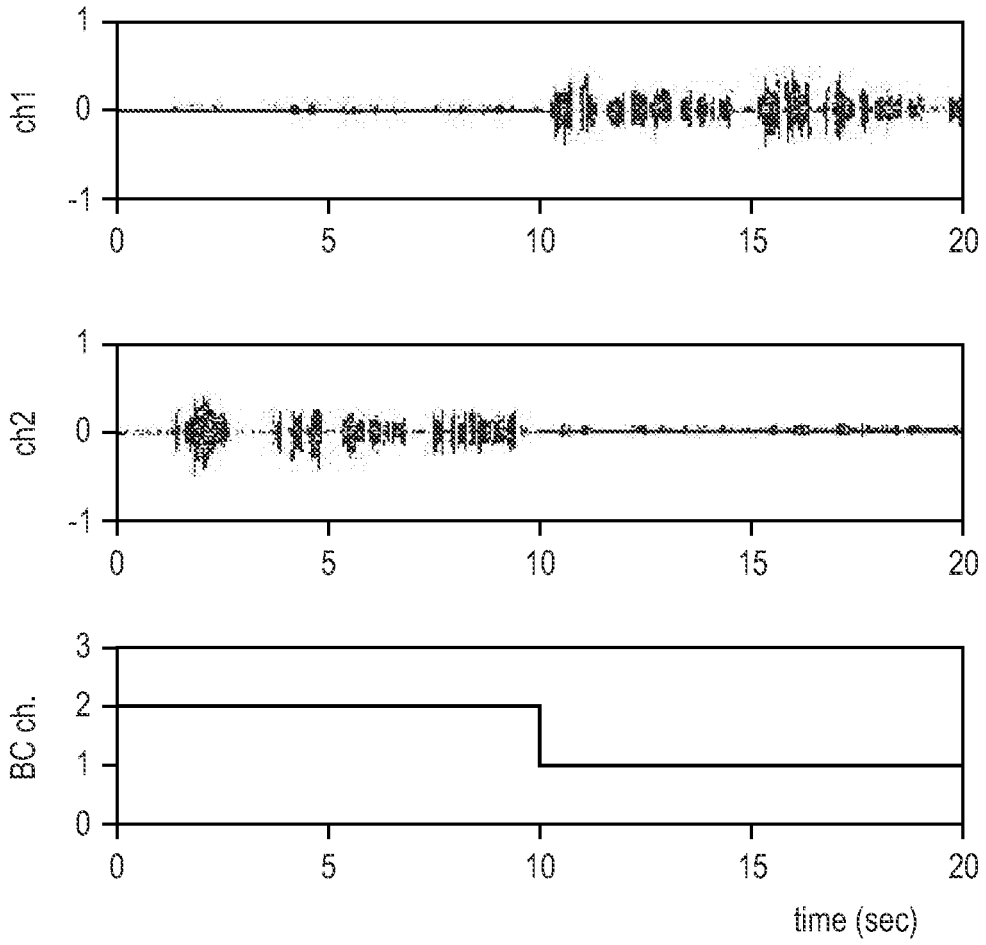
FIG. 7 is a graph showing the result of the action of a BC/AC discriminator module in a device according to the invention.

The graph in FIG. 7 illustrates the operation of the discriminator block 7 described above during a test procedure. In particular, during the first 10 seconds of the test, the second microphone 6 is in contact with a user (so it provides a BC audio signal) which is correctly identified by the discriminator block 7 (as shown in the bottom graph). In the next 10 seconds of the test, the first microphone 4 is in contact with the user instead (so it then provides a BC audio signal) and this is again correctly identified by the discriminator block 7.

Figure 8:
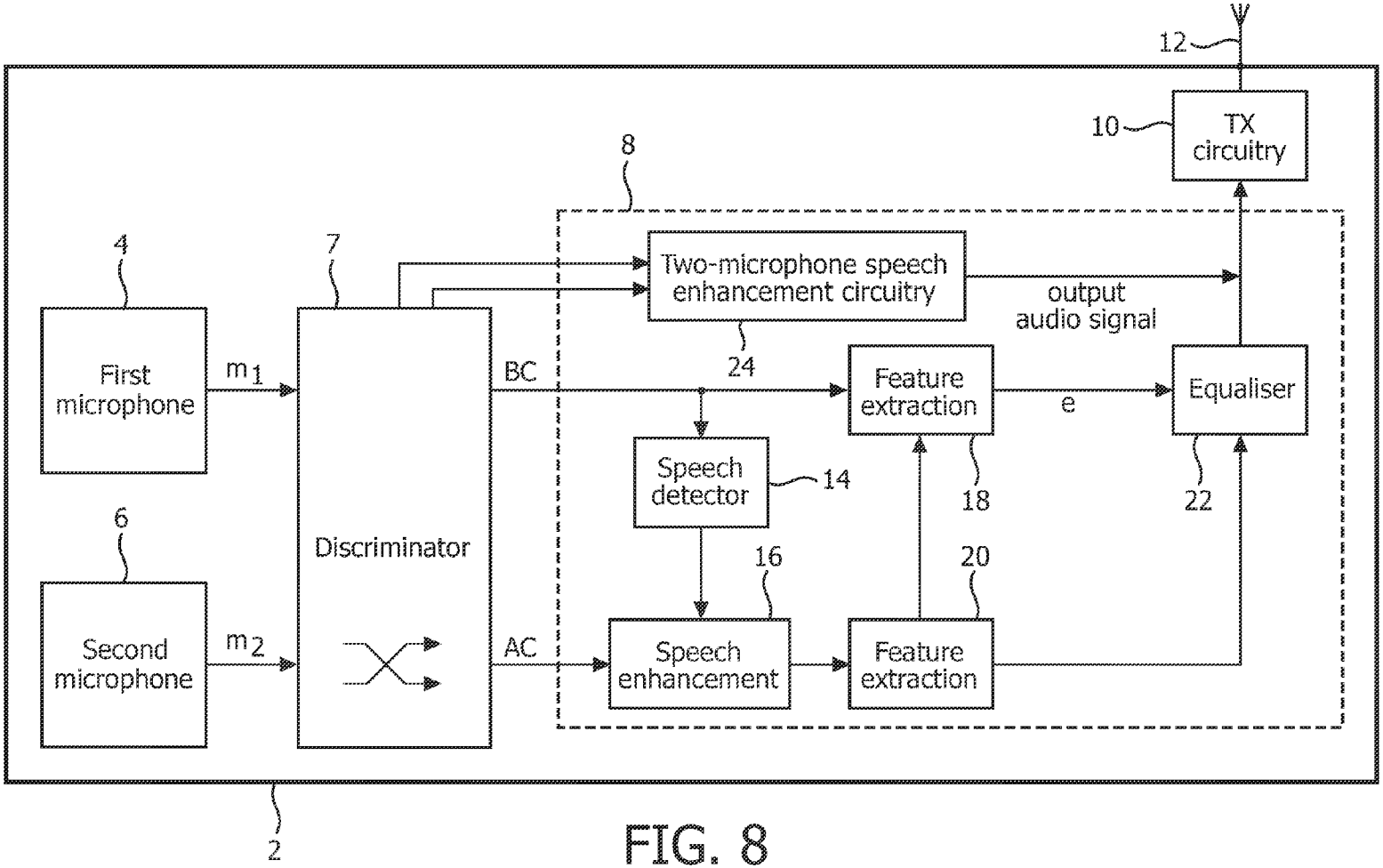
FIG. 8 is a block diagram of a device according to a second embodiment of the invention.

FIG. 8 shows an embodiment of the processing circuitry 8 of a device 2 according to the invention in more detail. The device 2 generally corresponds to that shown in FIG. 3, with features that are common to both device 2 being labeled with the same reference numerals.

Thus, in this embodiment, the processing circuitry 8 comprises a speech detection block 14 that receives the BC audio signal from the discriminator block 7, a speech enhancement block 16 that receives the AC audio signal from the discriminator block 7 and the output of the speech detection block 14, a first feature extraction block 18 that receives the BC audio signal and produces a signal, a second feature extraction block 20 that receives the output of the speech enhancement block 16 and an equalizer 22 that receives the signal from the first feature extraction block 18 and the output of second feature extraction block 20 and produces the output audio signal of the processing circuitry 8.

The processing circuitry 8 also includes further circuitry 24 for processing the audio signals from the first and second microphones 4, 6 when it is determined that both audio signals are AC audio signals. If used, the output of this circuitry 24 is provided to the transmitter circuitry 10 in place of the output audio signal from the equalizer block 22.

Briefly, the processing circuitry 8 uses properties or features of the BC audio signal and a speech enhancement algorithm to reduce the amount of noise in the AC audio signal, and then uses the noise-reduced AC audio signal to equalize the BC audio signal. The advantage of this particular audio signal processing method is that while the noise-reduced AC audio signal might still contain noise and/or artifacts, it can be used to improve the frequency characteristics of the BC audio signal (which generally does not contain speech artifacts) so that it sounds more intelligible.

The speech detection block 14 processes the received BC audio signal to identify the parts of the BC audio signal that represent speech by the user of the device 2. The use of the BC audio signal for speech detection is advantageous because of the relative immunity of the BC microphone 4 to background noise and the high SNR.

The speech detection block 14 can perform speech detection by applying a simple thresholding technique to the BC audio signal, by which periods of speech are detected when the amplitude of the BC audio signal is above a threshold value.

In other embodiments of the processing circuitry 8, it possible to suppress noise in the BC audio signal based on minimum statistics and/or beamforming techniques (in case more than one BC audio signal is available) before speech detection is carried out.

Figure 9:
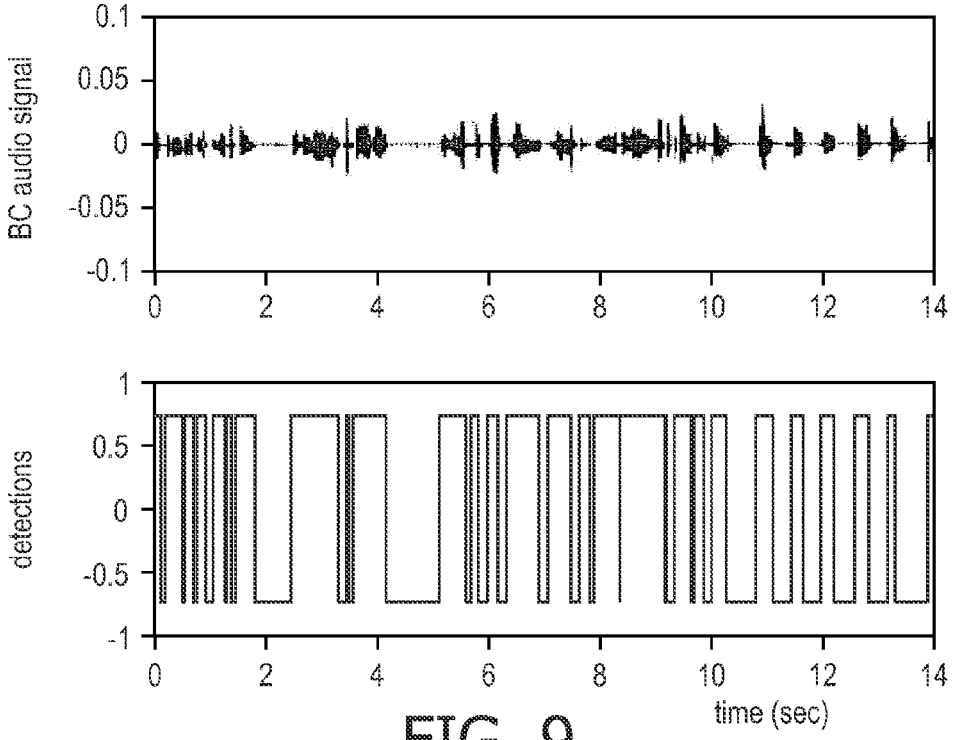
FIG. 9 is a graph showing the result of speech detection performed on a signal obtained using a BC microphone.

The graphs in FIG. 9 show the result of the operation of the speech detection block 14 on a BC audio signal.

The output of the speech detection block 14 (shown in the bottom part of FIG. 9) is provided to the speech enhancement block 16 along with the AC audio signal. Compared with the BC audio signal, the AC audio signal contains stationary and non-stationary background noise sources, so speech enhancement is performed on the AC audio signal so that it can be used as a reference for later enhancing (equalizing) the BC audio signal. One effect of the speech enhancement block 16 is to reduce the amount of noise in the AC audio signal.

Many different types of speech enhancement algorithms are known that can be applied to the AC audio signal by block 16, and the particular algorithm used can depend on the configuration of the microphones 4, 6 in the device 2, as well as how the device 2 is to be used.

In particular embodiments, the speech enhancement block 16 applies some form of spectral processing to the AC audio signal. For example, the speech enhancement block 16 can use the output of the speech detection block 14 to estimate the noise floors in the spectral domain of the AC audio signal during non-speech periods as determined by the speech detection block 14. The noise floor estimates are updated whenever speech is not detected.

In embodiments where the device 2 is designed to have more than one AC sensor or microphone (i.e. multiple AC sensors in addition to a sensor that is in contact with the user), the speech enhancement block 16 can also apply some form of microphone beamforming.

Figure 10:
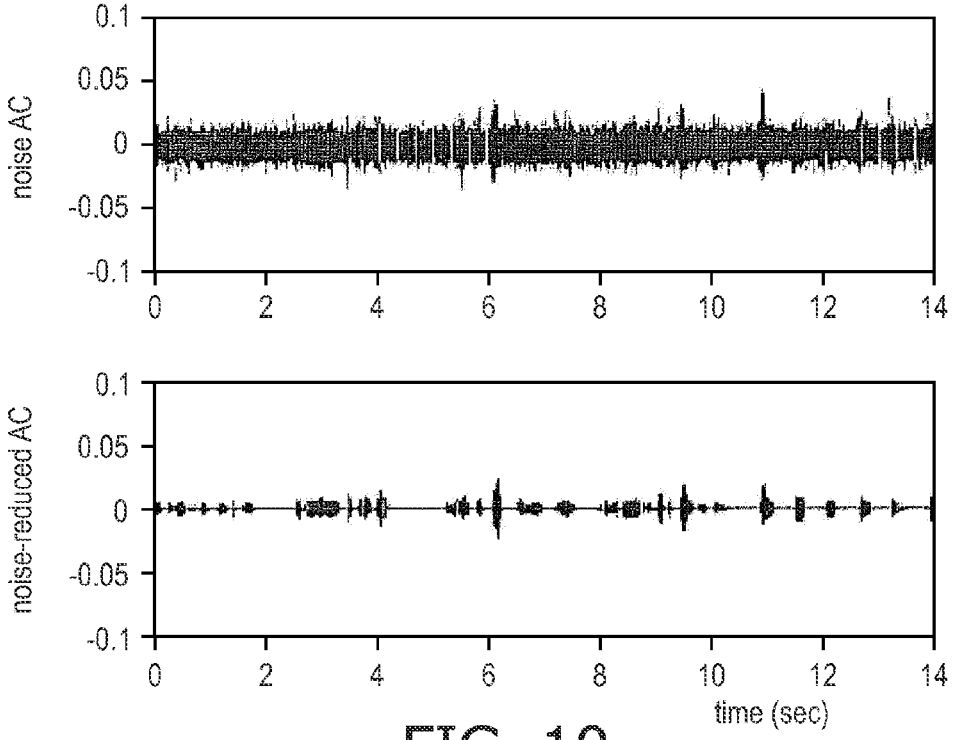
FIG. 10 is a graph showing the result of the application of a speech enhancement algorithm to a signal obtained using an AC microphone.

The top graph in FIG. 10 shows the AC audio signal obtained from the AC microphone 6 and the bottom graph in FIG. 10 shows the result of the application of the speech enhancement algorithm to the AC audio signal using the output of the speech detection block 14. It can be seen that the background noise level in the AC audio signal is sufficient to produce a SNR of approximately 0 dB and the speech enhancement block 16 applies a gain to the AC audio signal to suppress the background noise by almost 30 dB. However, it can also be seen that although the amount of noise in the AC audio signal has been significantly reduced, some artifacts remain.

The noise-reduced AC audio signal is then used as a reference signal to increase the intelligibility of (i.e. enhance) the BC audio signal.

In some embodiments of the processing circuitry 8, it is possible to use long-term spectral methods to construct an equalization filter, or alternatively, the BC audio signal can be used as an input to an adaptive filter which minimizes the mean-square error between the filter output and the enhanced AC audio signal, with the filter output providing an equalized BC audio signal. Yet another alternative makes use of the assumption that a finite impulse response can model the transfer function between the BC audio signal and the enhanced AC audio signal. Using an adaptive filter with the BC audio signal as an input and the enhanced AC audio signal as a reference, the output of the adaptive filter is an equalized BC audio signal. In these embodiments, it will be appreciated that the equalizer block 22 requires the original BC audio signal in addition to the features extracted from the BC audio signal by feature extraction block 18. In this case, there will be an extra connection between the BC audio signal input line and the equalizing block 22 in the processing circuitry 8 shown in FIG. 8.

However, methods based on linear prediction can be better suited for improving the intelligibility of speech in a BC audio signal, so preferably the feature extraction blocks 18, 20 are linear prediction blocks that extract linear prediction coefficients from both the BC audio signal and the noise-reduced AC audio signal, which used to construct an equalization filter, as described further below.

Linear prediction (LP) is a speech analysis tool that is based on the source-filter model of speech production, where the source and filter correspond to the glottal excitation produced by the vocal cords and the vocal tract shape, respectively. The filter is assumed to be all-pole. Thus, LP analysis provides an excitation signal and a frequency-domain envelope represented by the all-pole model which is related to the vocal tract properties during speech production.

The model is given as $$y(n) = -\sum_{k=1}^{p} a_k y(n-k) + Gu(n) \tag{9}$$

where y(n) and y(n−k) correspond to the present and past signal samples of the signal under analysis, u(n) is the excitation signal with gain G, $a_k$ represents the predictor coefficients, and p the order of the all-pole model.

The goal of LP analysis is to estimate the values of the predictor coefficients given the audio speech samples, so as to minimize the error of the prediction $$e(n) = y(n) + \sum_{k=1}^{p} a_k y(n-k) \tag{10}$$

where the error actually corresponds to the excitation source in the source-filter model. e(n) is the part of the signal that cannot be predicted by the model since this model can only predict the spectral envelope, and actually corresponds to the pulses generated by the glottis in the larynx (vocal cord excitation).

It is known that additive white noise severely effects the estimation of LP coefficients, and that the presence of one or more additional sources in y(n) leads to the estimation of an excitation signal that includes contributions from these sources. Therefore it is important to acquire a noise-free audio signal that only contains the desired source signal in order to estimate the correct excitation signal.

The BC audio signal is such a signal. Because of its high SNR, the excitation source e can be correctly estimated using LP analysis performed by linear prediction block 18. This excitation signal e can then be filtered using the resulting all-pole model estimated by analyzing the noise-reduced AC audio signal. Because the all-pole filter represents the smooth spectral envelope of the noise-reduced AC audio signal, it is more robust to artifacts resulting from the enhancement process.

As shown in FIG. 8, linear prediction analysis is performed on both the BC audio signal (using linear prediction block 18) and the noise-reduced AC audio signal (by linear prediction block 20). The linear prediction is performed for each block of audio samples of length 32 ms with an overlap of 16 ms. A pre-emphasis filter can also be applied to one or both of the signals prior to the linear prediction analysis. To improve the performance of the linear prediction analysis and subsequent equalization of the BC audio signal, the noise-reduced AC audio signal and BC signal can first be time-aligned (not shown) by introducing an appropriate time-delay in either audio signal. This time-delay can be determined adaptively using cross-correlation techniques.

During the current sample block, the past, present and future predictor coefficients are estimated, converted to line spectral frequencies (LSFs), smoothed, and converted back to linear predictor coefficients. LSFs are used since the linear prediction coefficient representation of the spectral envelope is not amenable to smoothing. Smoothing is applied to attenuate transitional effects during the synthesis operation.

The LP coefficients obtained for the BC audio signal are used to produce the BC excitation signal e. This signal is then filtered (equalized) by the equalizing block 22 which simply uses the all-pole filter estimated and smoothed from the noise-reduced AC audio signal $$H(z) = \frac{1}{1 + \sum_{k=1}^{p} a_k z^{-k}} \tag{11}$$

Further shaping using the LSFs of the all-pole filter can be applied to the AC all-pole filter to prevent unnecessary boosts in the effective spectrum.

If a pre-emphasis filter is applied to the signals prior to LP analysis, a de-emphasis filter can be applied to the output of H(z). A wideband gain can also be applied to the output to compensate for the wideband amplification or attenuation resulting from the emphasis filters.

Thus, the output audio signal is derived by filtering a 'clean' excitation signal e obtained from an LP analysis of the BC audio signal using an all-pole model estimated from LP analysis of the noise-reduced AC audio signal.

Figure 11:
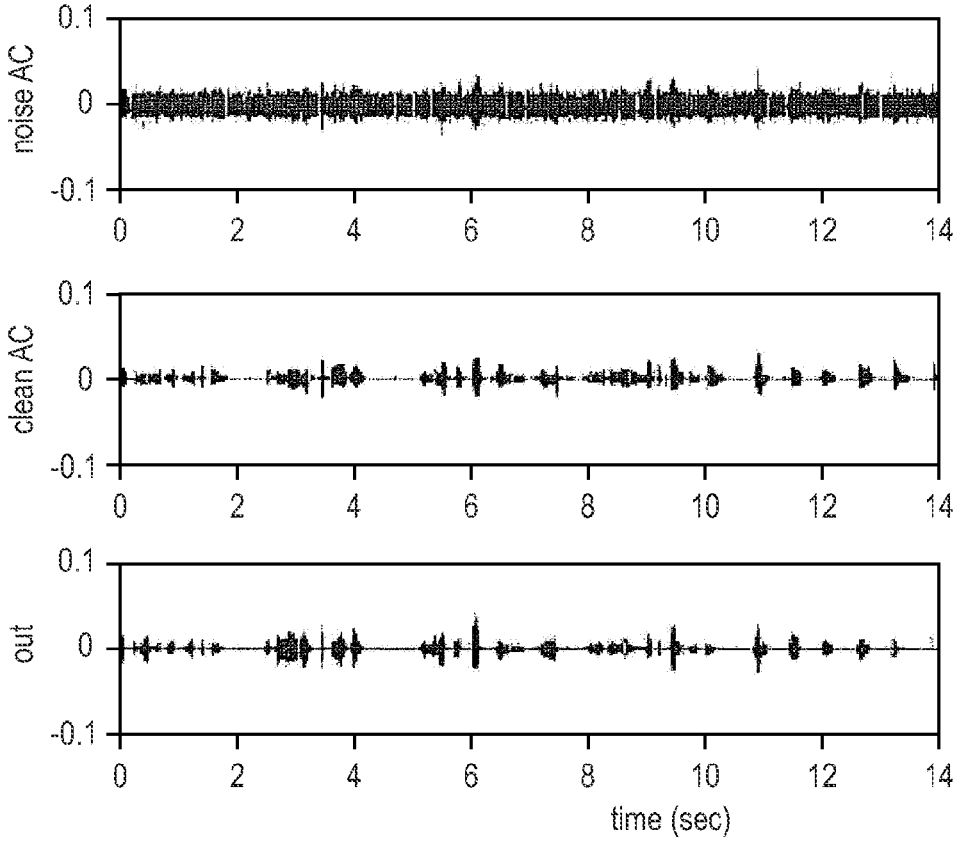
FIG. 11 is a graph showing a comparison between signals obtained using an AC microphone in a noisy and clean environment and the output of the method according to the invention.

FIG. 11 shows a comparison between the AC microphone signal in a noisy and clean environment and the output of the processing circuitry 8 when linear prediction is used. Thus, it can be seen that the output audio signal contains considerably less artifacts than the noisy AC audio signal and more closely resembles the clean AC audio signal.

Figure 12:
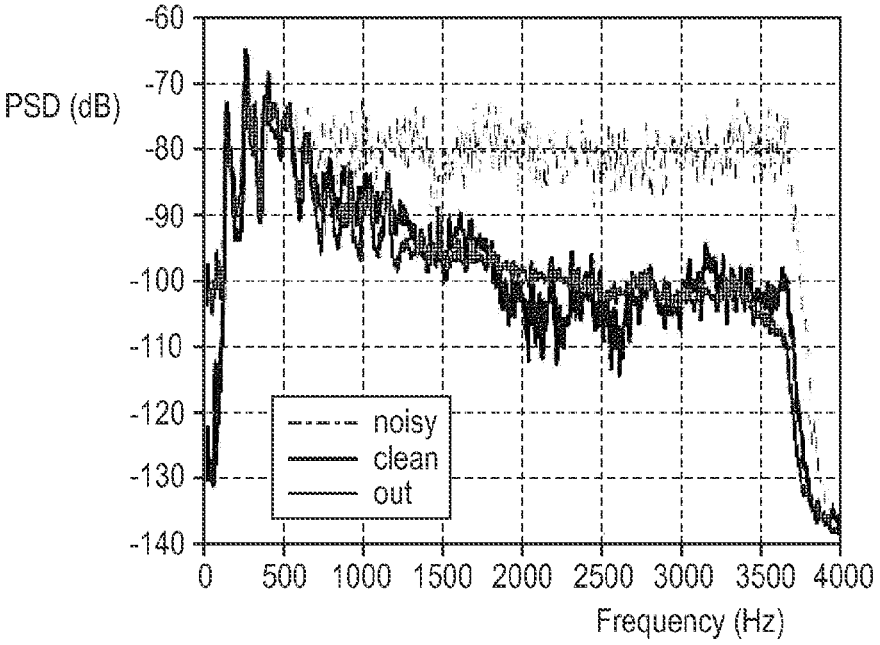
FIG. 12 is a graph showing a comparison between the power spectral densities of the three signals shown in FIG. 11.

FIG. 12 shows a comparison between the power spectral densities of the three signals shown in FIG. 11. Also here it can be seen that the output audio signal spectrum more closely matches the AC audio signal in a clean environment.

Thus, this embodiment of the processing circuitry 8 allows a clean (or at least intelligible) speech audio signal to be produced in a poor acoustic environment where the speech is either degraded by severe noise or reverberation.

In a further embodiment of the processing circuitry 8 (not illustrated in FIG. 8), a second speech enhancement block is provided for enhancing (reducing the noise in) the BC audio signal provided by the discriminator block 7 prior to performing linear prediction. As with the first speech enhancement block 16, the second speech enhancement block receives the output of the speech detection block 14. The second speech enhancement block is used to apply moderate speech enhancement to the BC audio signal to remove any noise that may leak into the microphone signal. Although the algorithms executed by the first and second speech enhancement blocks can be the same, the actual amount of noise suppression/speech enhancement applied will be different for the AC and BC audio signals.

It will be appreciated that the pendant 2 shown in FIG. 2 or other non-pendant devices incorporating the invention described above can include more than two microphones. For example, the cross-section of the pendant 2 could be triangular (requiring three microphones, one on each face) or square (requiring four microphones, one on each face). It is also possible for a device 2 to be configured so that more than one microphone can obtain a BC audio signal. In this case, it is possible to combine the audio signals from multiple AC (or BC) microphones prior to the speech enhancement processing by the circuitry 8 using, for example, beamforming techniques, to produce an AC (or BC) audio signal with an improved SNR. This can help to further improve the quality and intelligibility of the audio signal output by the processing circuitry 8.

When using more than one microphone of a particular type (e.g. AC and/or BC) in such devices, a general method for classifying the microphones as either AC or BC per device can be described as follows. Firstly, perform the pair-wise classification as described in FIG. 5 or 6 among the microphones, and group them as either AC, BC, or uncertain. Next re-perform the pair-classification, this time between those microphones categorized as uncertain and BC signals. If two microphones are still categorized as uncertain, then they belong to the BC group, otherwise they belong to the AC group of microphones. The second step can also be performed using the AC group instead of the BC group.

Figure 13:
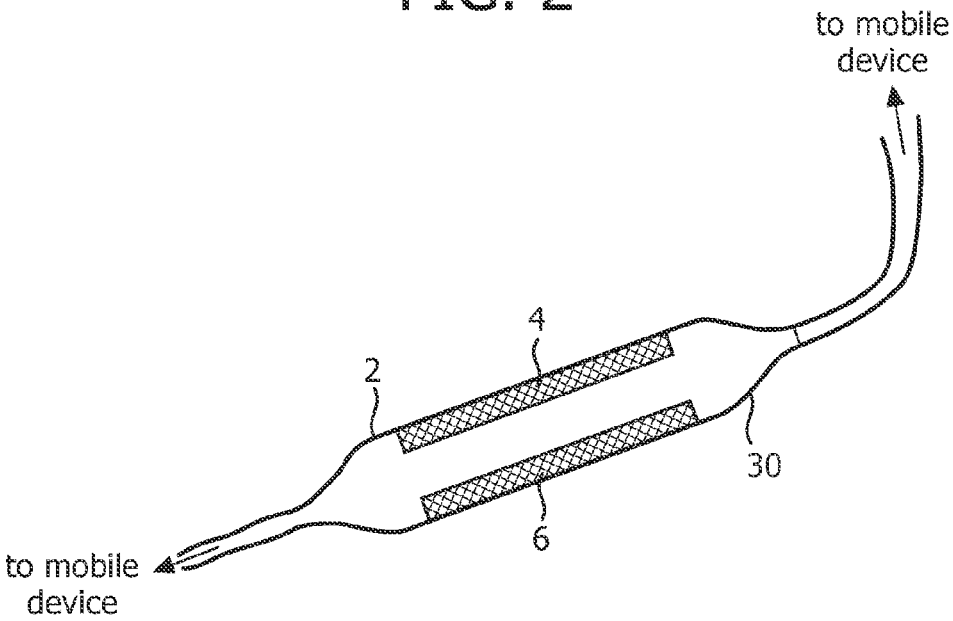
FIG. 13 shows a wired hands-free kit for a mobile telephone including two microphones.

Although the invention has been described above in terms of a pendant that is part of MPERS, it will be appreciated that the invention can be implemented in other types of electronic device that use sensors or microphones to detect speech. One type of device 2 is shown in FIG. 13 which is a wired hands-free kit that can be connected to a mobile telephone to provide hands-free functionality. The device 2 comprises an earpiece (not shown) and a microphone portion 30 comprising two microphones 4, 6 that, in use, is placed proximate to the mouth or neck of the user. The microphone portion is configured so that either of the two microphones 4, 6 can be in contact with the neck of the user, depending on the orientation of the microphone portion at any given time.

It will be appreciated that the discriminator block 7 and/or processing circuitry 8 shown in FIGS. 2 and 7 can be implemented as a single processor, or as multiple interconnected processing blocks. Alternatively, it will be appreciated that the functionality of the processing circuitry 8 can be implemented in the form of a computer program that is executed by a general purpose processor or processors within a device. Furthermore, it will be appreciated that the processing circuitry 8 can be implemented in a separate device to a device housing the first and/or second microphones 4, 6, with the audio signals being passed between those devices.

It will also be appreciated that the discriminator block 7 and processing circuitry 8 can process the audio signals on a block-by-block basis (i.e. processing one block of audio samples at a time). For example, in the discriminator block 7, the audio signals can be divided into blocks of N audio samples prior to the application of the FFT. The subsequent processing performed by the discriminator block 7 is then performed on each block of N transformed audio samples. The feature extraction blocks 18, 20 can operate in a similar way.

There is therefore provided a device and method of operating the same that allows an audio signal representing the speech of a user to be obtained from BC and AC audio signals, even where the device is free to move relative to the user, causing the microphone providing the BC and AC signals to change.

While the invention has been illustrated and described in detail in the drawings and foregoing description, such illustration and description are to be considered illustrative or exemplary and not restrictive; the invention is not limited to the disclosed embodiments.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A method of operating a device, the device comprising a plurality of audio sensors and being configured such that when a first audio sensor of the plurality of audio sensors is in contact with a user of the device, a second audio sensor of the plurality of audio sensors is in contact with the air, the method comprising:

obtaining respective audio signals representing the speech of a user from the plurality of audio sensors;

analyzing the respective audio signals to determine which, if any of the plurality of audio sensors is in contact with the user of the device, and providing the audio signals to circuitry that processes the audio signals to produce an output audio signal representing the speech of the user according to the result of the step of analyzing.

2. The method as claimed in claim 1, wherein the step of analyzing comprises analyzing the spectral properties of each of the audio signals.

3. The method as claimed in claim 1, wherein the step of analyzing comprises analyzing the power of the respective audio signals above a threshold frequency.

4. The method as claimed in claim 3, wherein it is determined that an audio sensor is in contact with the user of the device if the power of its respective audio signal above the threshold frequency is less than the power of an audio signal above the threshold frequency from another audio sensor by more than a predetermined amount.

5. The method as claimed in claim 1, wherein the step of analyzing comprises:

applying an N-point Fourier transform to each audio signal;

determining information on the power spectrum below a threshold frequency for each of the Fourier-transformed audio signals;

normalizing the Fourier-transformed audio signals from the two sensors with respect to each other according to the determined information; and comparing the power spectrum above the threshold frequency of the normalized Fourier-transformed audio signals to determine which, if any, of the plurality of audio sensors is in contact with the user of the device.

6. The method as claimed in claim 5, wherein the step of determining information comprises determining the value of a maximum peak in the power spectrum below the threshold frequency for each of the Fourier-transformed audio signals.

7. The method as claimed in claim 5, wherein the step of determining information comprises summing the power spectrum below the threshold frequency for each of the Fourier-transformed audio signals.

8. The method as claimed in claim 5, wherein it is determined that an audio sensor is in contact with the user of the device if the power spectrum above the threshold frequency for its respective Fourier-transformed audio signal is less than the power spectrum above the threshold frequency for a Fourier-transformed audio signal from another audio sensor by more than a predetermined amount.

9. The method as claimed in claim 5, wherein it is determined that no audio sensor is in contact with the user of the device if the power spectrums above the threshold frequency for the Fourier-transformed audio signals differ by less than a predetermined amount.

10. A device, comprising:

a plurality of audio sensors arranged in the device such that when a first audio sensor of the plurality of audio sensors is in contact with a user of the device, a second audio sensor of the plurality of audio sensors is in contact with the air;

circuitry that is configured to:

obtain respective audio signals representing the speech of a user from the plurality of audio sensors;

analyze the respective audio signals to determine which, if any, of the plurality of audio sensors is in contact with the user of the device; and processing circuitry for processing the audio signals to produce an output audio signal representing the speech of the user.

11. The device as claimed in claim 10, wherein the circuitry is configured to analyze the power of the respective audio signals above a threshold frequency.

12. The device as claimed in claim 10, wherein the circuitry is configured to analyze the respective audio signals by:

applying an N-point Fourier transform to each audio signal;

determining information on the power spectrum below a threshold frequency for each of the Fourier-transformed audio signals;

normalizing the Fourier-transformed audio signals from the two sensors with respect to each other according to the determined information; and comparing the power spectrum above the threshold frequency of the normalized Fourier-transformed audio signals to determine which, if any, of the plurality of audio sensors is in contact with the user of the device.

13. A non-transitory computer program product comprising computer readable code that is configured such that, on execution of the computer readable code by a processor, the code causes the processor to perform the method as claimed in claim 1.

* * * * *